US008176570B2

(12) United States Patent
Bedard et al.

(10) Patent No.: US 8,176,570 B2
(45) Date of Patent: May 15, 2012

(54) SPORTS GARMENT FOR COVERING PROTECTIVE EQUIPMENT

(75) Inventors: Sylvie Bedard, Granby (CA); Ross McCracken, Dorval (CA)

(73) Assignee: Sport Maska Inc., Montreal, Quebec (CA)

( * ) Notice: Subject to any disclaimer, the term of this patent is extended or adjusted under 35 U.S.C. 154(b) by 795 days.

(21) Appl. No.: 11/365,882

(22) Filed: Mar. 2, 2006

(65) Prior Publication Data

US 2007/0214540 A1 Sep. 20, 2007

(51) Int. Cl.
*A41D 27/12* (2006.01)
*A41D 13/08* (2006.01)

(52) U.S. Cl. ..... 2/59; 2/16

(58) Field of Classification Search ..... 2/24, 16, 2/59, 62, 455, 79
See application file for complete search history.

(56) References Cited

U.S. PATENT DOCUMENTS

| | | | | |
|---|---|---|---|---|
| 243,498 | A | | 6/1881 | Brown |
| 245,430 | A | | 8/1881 | Barhydt |
| 1,389,131 | A | | 8/1921 | Earnshaw |
| 1,714,491 | A | | 5/1929 | Burr |
| 2,941,210 | A | | 6/1960 | Bren |
| 3,013,276 | A | | 12/1961 | Maxwell |
| 3,037,210 | A | | 6/1962 | Neuman |
| 4,117,552 | A | * | 10/1978 | Simpson ..... 2/2.14 |
| 4,325,148 | A | | 4/1982 | Livernois |
| 4,608,716 | A | * | 9/1986 | Brumfield ..... 2/2.5 |
| 4,698,849 | A | | 10/1987 | Mitchell et al. |
| 5,031,242 | A | * | 7/1991 | Aldridge et al. ..... 2/81 |
| 5,072,454 | A | * | 12/1991 | Trahan ..... 2/70 |
| 5,247,708 | A | * | 9/1993 | Freese, Jr. ..... 2/79 |
| 5,349,704 | A | | 9/1994 | Masters |
| 5,608,913 | A | | 3/1997 | Lacoste |
| 5,717,999 | A | | 2/1998 | Lurry |
| 5,966,747 | A | * | 10/1999 | Crupi et al. ..... 2/466 |
| 6,185,745 | B1 | | 2/2001 | Alger |
| 2006/0277651 | A1 | | 12/2006 | Razzaghi et al. |

* cited by examiner

*Primary Examiner* — Gary L Welch
*Assistant Examiner* — Amber Anderson
(74) *Attorney, Agent, or Firm* — Norton Rose Canada LLP

(57) ABSTRACT

A garment having a substantially tubular body configured to cover at least one of an upper and a lower torso of a wearer, and at least one pair of tubular portions extending from the body and configured for surrounding corresponding limbs of the wearer, each tubular portion including a tubular insert having a length increasing around a perimeter thereof from a minimum length to a maximum length, the tubular insert providing excess material in the tubular portion along the maximum length to locally increase a width of the tubular portion. The garment can be for example pants or a jersey.

12 Claims, 5 Drawing Sheets

SPORTS GARMENT FOR COVERING PROTECTIVE EQUIPMENT

BACKGROUND OF THE INVENTION

1. Field of the Invention

The present invention relates to garments to be worn over equipment such as, for example, protective equipment. In particular, the present invention provides for a garment such as a jersey or pants configured to be worn over protective equipment, such that the range of motion of the arms or legs covered by the protective equipment is not unduly impeded by the garment.

2. Background Art

In contact sports such as hockey, lacrosse, football, or others, a player is required to wear a number of pieces of protective equipment, for example elbow pads. As the player usually wears a garment such as a jersey over the equipment, the garment is required to be substantially large in size in order to effectively contain the protective equipment.

However, enlarged garments, for example jerseys having enlarged sleeves to contain elbow pads, provide more opportunities for an opponent to grab and restrain the player by the loose material, for example the loose material of the enlarged sleeve surrounding parts of the arm not protected by the elbow pad.

On the other hand, a garment that is too tight, especially where surrounding a joint such as an elbow or knee protected by a pad, can impede the motion of the joint through the interaction of the pad and garment, thus being detrimental to the wearer's performance.

SUMMARY OF INVENTION

It is therefore an aim of the present invention to provide an improved garment to be worn over protective equipment without substantially impeding motions of the wearer.

It is also an aim of the present invention to provide an improved garment having enlarged sections to cover protective equipment.

Therefore, in accordance with the present invention, there is provided a garment comprising a substantially tubular body configured to cover at least one of an upper and a lower torso of a wearer, and at least one pair of tubular portions extending from the body and configured for surrounding corresponding limbs of the wearer, each tubular portion including a tubular insert having a length increasing around a perimeter thereof from a minimum length to a maximum length, the tubular insert providing excess material in the tubular portion along the maximum length to locally increase a width of the tubular portion.

Also in accordance with the present invention, there is provided a garment comprising a substantially tubular body configured to cover at least one of an upper and a lower torso of a wearer, and at least one pair of tubular portions extending from the body and configured for surrounding corresponding limbs of the wearer, a width of each tubular portion progressively increasing from a first point to a second point and progressively decreasing from the second point to a third point, the first point being closer to a connection between the tubular portion and the body than the third point and the second point being located between the first and third points.

BRIEF DESCRIPTION OF THE DRAWINGS

Reference will now be made to the accompanying drawings, showing by way of illustration a particular embodiment of the present invention and in which.

DETAILED DESCRIPTION OF PARTICULAR EMBODIMENTS

Figure 1:
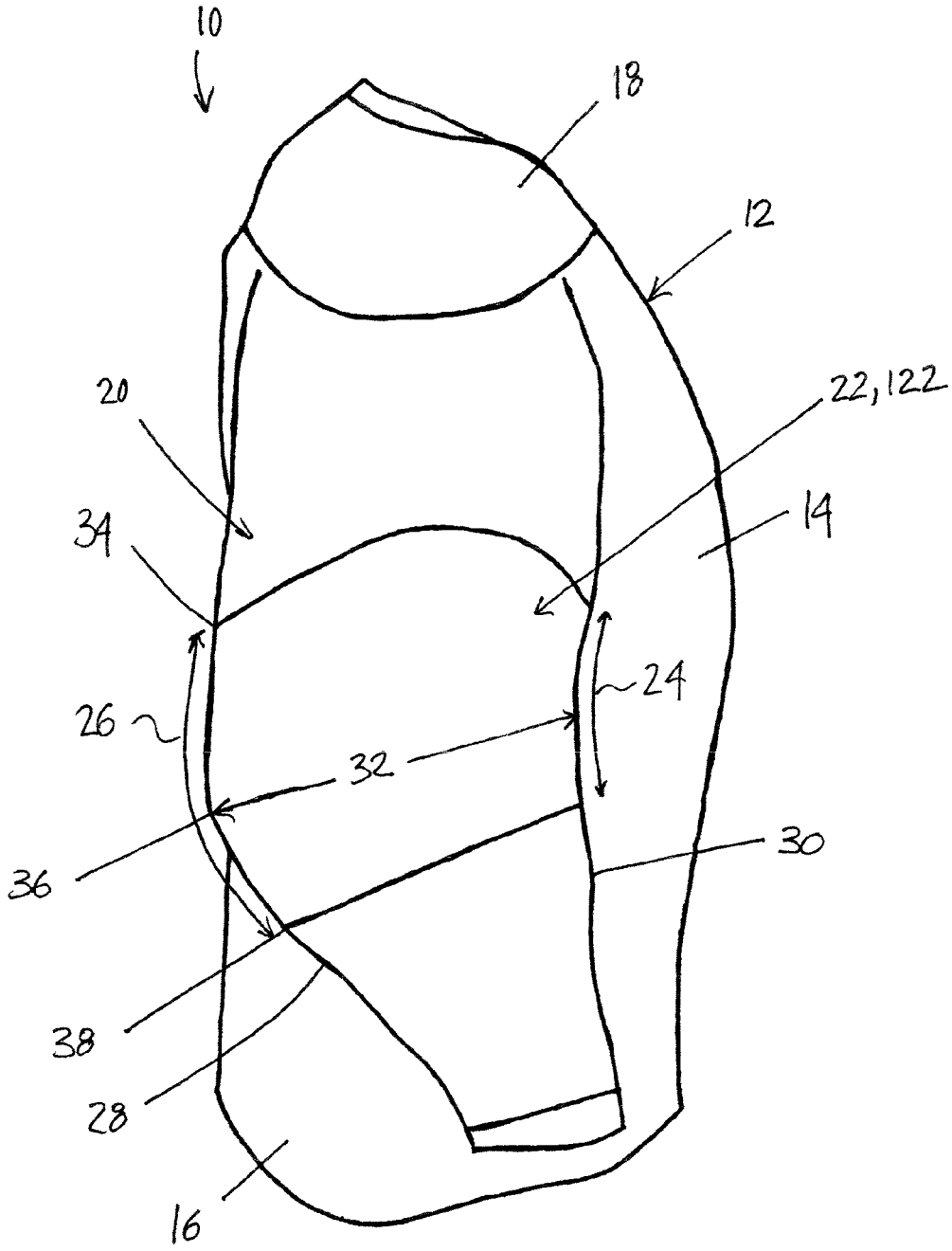
FIG. 1 is a side view of a jersey according to a particular embodiment of the present invention.
Figure 2:
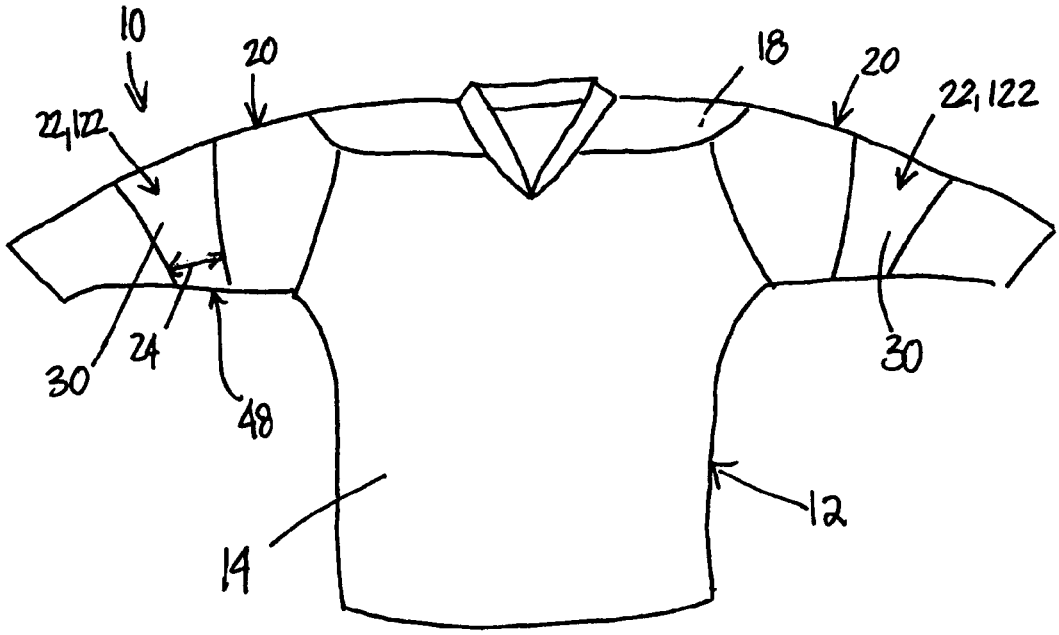
FIG. 2 is a front view of the jersey of FIG. 1.
Figure 3:
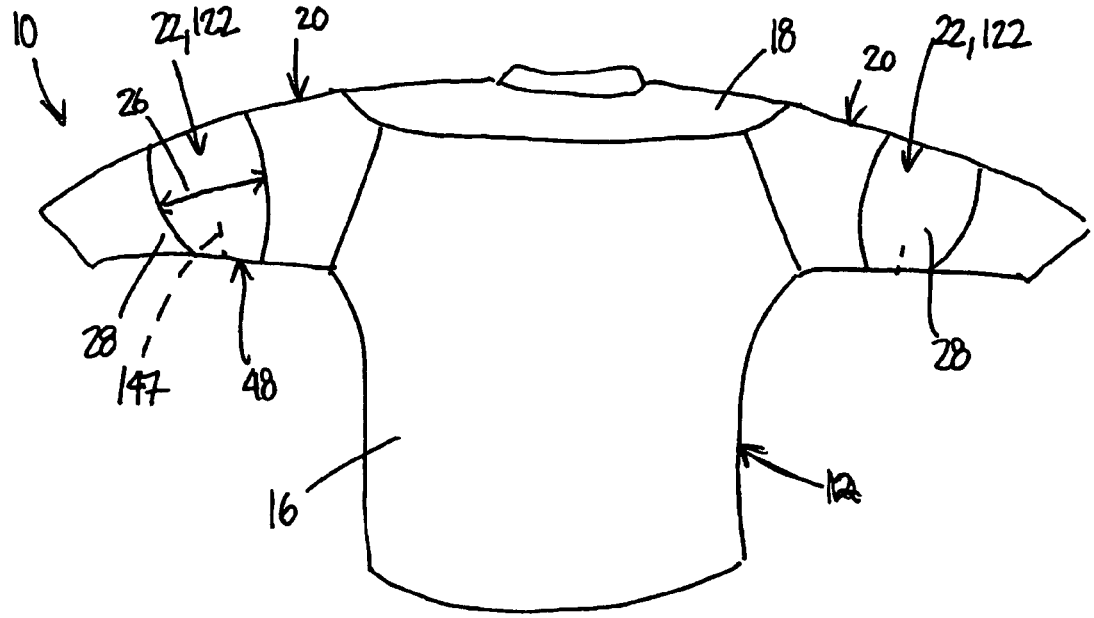
FIG. 3 is a rear view of the jersey of FIG. 1.

Referring now to FIGS. 1-3, a sports jersey 10 according to a particular embodiment of the present invention, which can be for example a hockey jersey, is shown. The jersey 10 includes a tubular body 12 defining a chest portion 14, a back portion 16 and a shoulder portion 18 which are interconnected and configured for respectively covering a chest, a back and shoulders of a wearer. The various portions 14,16,18 can be separately formed and assembled together, or two or more of the portions 14,16,18 can be integrally formed from a single panel of material or cloth. Alternately, any of the portions 14,16,18 can be composed of a plurality of assembled panels.

The jersey 10 also includes a pair of tubular portions or sleeves 20, each extending from the body 12 for containing at least part of an arm of the wearer. Each sleeve 20 includes a tubular insert 22,122 which is located to surround the elbow joint of the wearer. The insert 22,122 has a length progressively increasing around its perimeter from a minimum length 24 to a maximum length 26, as can be best seen in FIG. 1. The maximum length 26 is located along the back 28 of the sleeve 20 (see FIGS. 1 and 3), substantially over the elbow of the wearer, such as to provide excess material around the elbow for containing an elbow pad. The minimum length 24 is located along the front 30 of the sleeve 20 (see FIGS. 1-2).

Referring to FIG. 1, the excess material along the back 28 of the sleeve 20 provided by the insert 22,122 provides a local increase in the width 32 of the sleeve 20 around the location of the elbow pad. Thus, the width 32 progressively increases from a first point 34 to a second point 36 and progressively decreases from the second point 36 to a third point 38, the first point 34 being closer to the connection of the sleeve 20 with the jersey body 12 than the third point 38 and the second point 36 being located between the first and third points 34,38. The minimum length 24 of the insert 22,122 at the front 30 of the sleeve 20 minimizes the quantity of material in a portion of the sleeve 20 where excess material is not required. The excess material along the back 28 of the sleeve 20 facilitates the bending of the elbow joint by reducing the interaction between the material of the sleeve 20 and the elbow pad contained therein.

Figure 4:
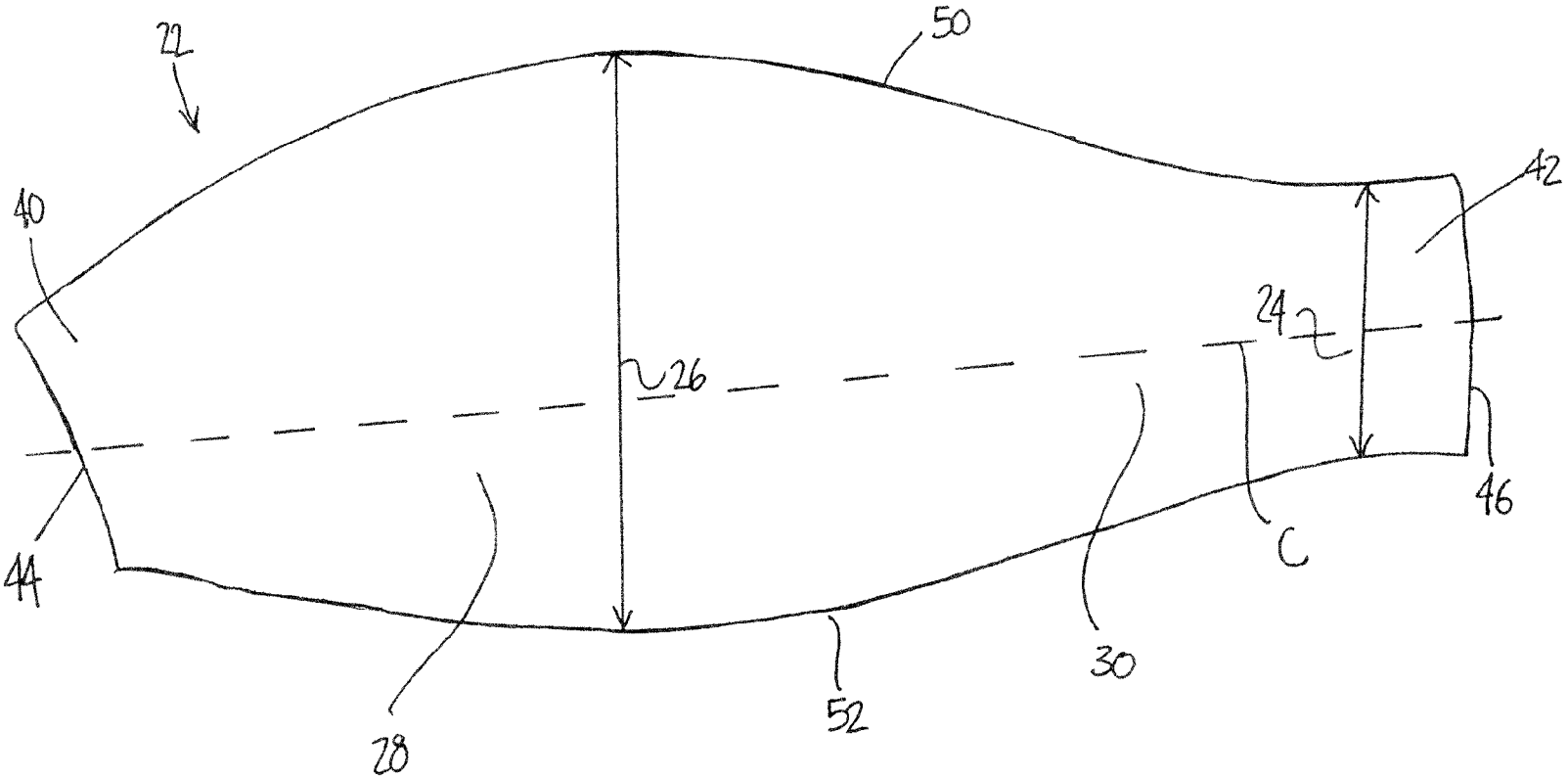
FIG. 4 is a top plan view of an unassembled gusset that can form part of a sleeve of the jersey of FIG. 1.

Referring to FIG. 4, a particular configuration for the insert 22 is shown in its unassembled form. The insert 22 includes first and second opposed ends 40,42 respectively defining first and second longitudinal edges 44,46 having a similar length and defining a transversal central line C therebetween, the longitudinal edges 44,46 being joined together to form the assembled insert 22. In the example shown, the joined longitudinal edges 44,46 of the insert 22 in the sleeve 20 are located along the underside 48 of the sleeve 20 (see FIGS. 2-3). The insert 22 also includes two curved transversal edges 50,52 extending between the two longitudinal edges 44,46. The curved transversal edges 50,52 curve away from each other in the back 28 of the sleeve 20, such as to define the maximum length 26 therebetween. The transversal edges 50,52 also curve toward each other in the front 30 of the sleeve 20, such as to define the minimum length 24 therebetween.

Figure 5:
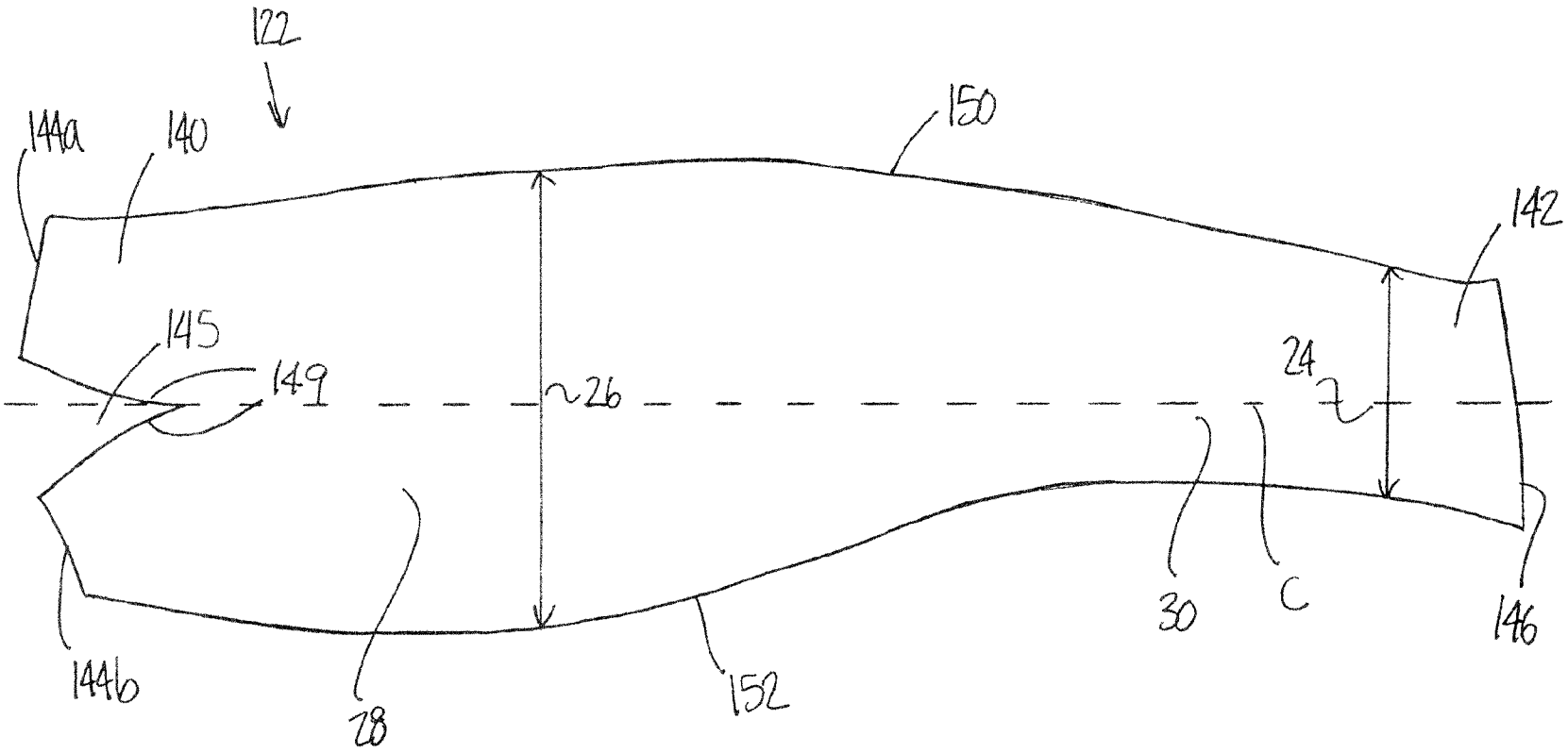
FIG. 5 is a top plan view of an alternate unassembled gusset that can form part of the sleeve of the jersey of FIG. 1.

Referring to FIG. 5, an alternative configuration for the insert 122 is shown in its unassembled form. The insert 122 includes first and second opposed ends 140,142, the first end 140 having a cut-out 145, for example, a triangular cut-out, defined therein such as to form two first longitudinal edges 144*a,b* which, together, have a similar length than a second longitudinal edge 146 defined by the second end 142. Here again, the first longitudinal edges 144*a,b* are joined to the second longitudinal edge 146 to form the assembled insert 122, with the cut-out edges 149 being attached together, as illustrated in FIG. 3 by the dotted line 147. The joined longitudinal edges 144*a,b*, 146 of the insert 122 in the sleeve 20 are located along the underside 48 of the sleeve 20 (see FIGS. 2-3). Two curved transversal edges 150,152 extend between the first and second longitudinal edges 144*a,b*, 146, curving away from each other in the back 28 of the sleeve 20 such as to define the maximum length 26 therebetween, and toward each other in the front 30 of the sleeve 20 such as to define the minimum length 24 therebetween.

Other configurations for the insert 22,122 are also possible, for example longitudinal edges 44,144,46,146*a,b* of the insert 22,122 in the sleeve 20 located along the back 28 of the sleeve 20 and defining the maximum length 26, or located along the front 30 of the sleeve 20 and defining the minimum length 24, and/or an insert 22,122 composed of a plurality of pieces attached together, and/or an insert 22,122 having a plurality of cut-outs such as 145 defined in the longitudinal edges 44,144,46,146*a,b*, and/or an insert 22,122 with straight transversal edges 50,150,52,152, etc.

Figure 6:
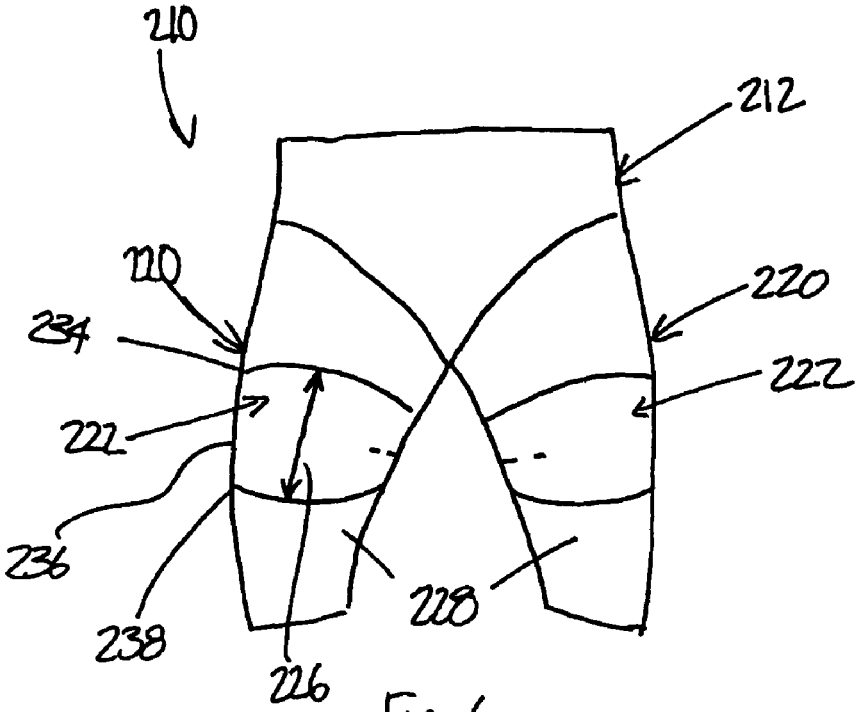
FIG. 6 is a front view of pants according to an alternate embodiment of the present invention.
Figure 7:
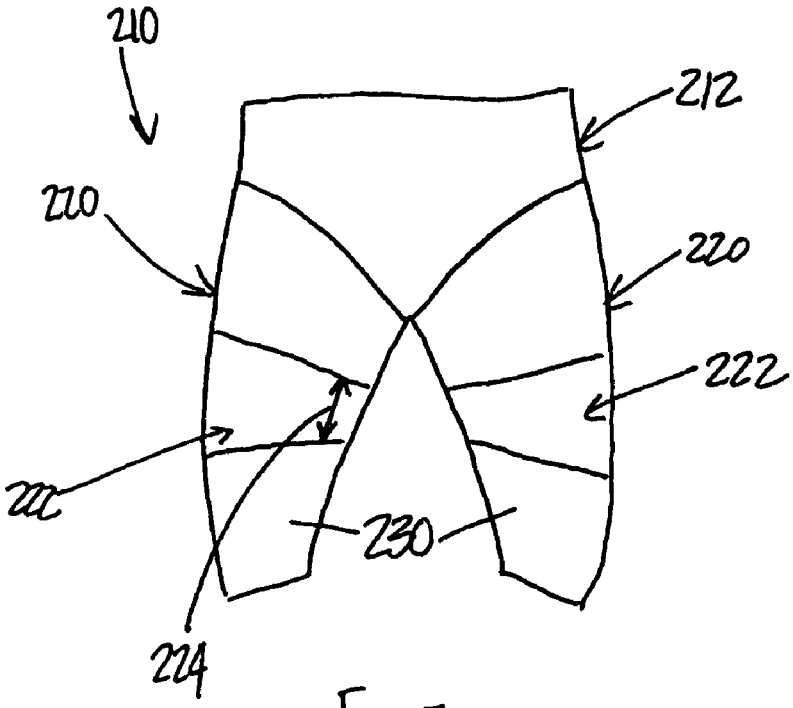
FIG. 7 is a rear view of the pants of FIG. 6.

Referring to FIGS. 6-7, pants 210 according to an alternative embodiment of the present invention are shown. The pants 210 have a substantially tubular body 212 configured to cover the lower torso of the wearer including the hips. The body 212 can be formed of a single panel or a plurality of interconnected panels. The body 212 can include various types of fastening means, for example buttons, cords, snaps, zipper, etc. (not shown). The pants 210 also include a pair of tubular portions or legs 220, each extending from the body 212 for containing at least part of a leg of the wearer. The legs 220 may be similar in configuration to the arms of the jersey previously shown and described, i.e. each leg 220 may include a tubular insert 222 similar to the insert 22,122 which is located to surround the knee joint of the wearer. The insert 222, like the insert 22,122 of the jersey 10, has a length progressively increasing around its perimeter from a minimum length 224 to a maximum length 226. However, in the case of the pant leg 220 the maximum length 226 is located along the front 230 of the leg 220. The maximum length 226 is located substantially over the knee of the wearer such as to provide excess material around the knee for containing a knee pad, and the minimum length 224 is located along the back 228 of the leg 220.

The excess material provided along the front 230 of the leg 220 provides a local increase in the width (not shown—see the width 32 of the sleeve 20 shown in FIG. 1) of the leg 220 around the location of the knee pad. Thus, the width progressively increases from a first point 234 to a second point 236 and progressively decreases from the second point 236 to a third point 238, the first point 234 being closer to the connection of the leg 220 with the pant body 212 than the third point 238 and the second point 236 being located between the first and third points 234,238.

Although the present invention has been described with hockey jersey and pants, it is to be understood that the present invention can be similarly applied to other types of garments, for example garments for other types of contact sports necessitating protective equipment (e.g. football, lacrosse, etc.), garments to be worn over other types of bulky equipment (e.g. casts, medical devices, other protective wear, etc.). In these other applications, the location of the width variation in the tubular portion of the garment (e.g. sleeve, leg) surrounding the bulky equipment is determined by the position of that equipment on the body of the wearer.

The embodiments of the invention described above are intended to be exemplary. Those skilled in the art will therefore appreciate that the foregoing description is illustrative only, and that various alternate configurations and modifications can be devised without departing from the spirit of the present invention. Accordingly, the present invention is intended to embrace all such alternate configurations, modifications and variances which fall within the scope of the appended claims.

Titre: SPORTS GARMENT FOR COVERING PROTECTIVE EQUIPMENT - #1979854

| No. Dossier 17720-40US | Date: 5 JANVIER 2006 |
|---|---|
| 1- | 51 - |
| 2 - | 52- TRANSVERSAL EDGE |
| 3 - | 53 - |
| 4 - | 54 - |
| 5 - | 55 - |
| 6 - | 56 - |
| 7 - | 57 - |
| 8 - | 58 - |
| 9 - | 59 - |
| 10 - JERSEY | 60 - |
| 11 - | 61 - |
| 12 - TUBULAR BODY | 62 - |
| 13- | 63 - |
| 14 - CHEST PORTION | 64 - |
| 15 - | 65 - |
| 16 - BACK PORTION | 66 - |
| 17 - | 67 - |
| 18 - SHOULDER PORTION | 68 - |
| 19 - | 69 - |
| 20 - SLEEVE | 70 - |
| 21 - | 71 - |
| 22 - INSERT | 72 - |
| 23 - | 73 - |
| 24 - MINIMUM LENGTH | 74 - |
| 25 - | 75 - |
| 26 - MAXIMUM LENGTH | 76 - |
| 27 - | 77 - |
| 28 - BACK OF 20 | 78 - |
| 29 - | 79 - |
| 30 - FRONT OF 20 | 80 - |
| 31 - | 81 - |
| 32 - EFFECTIVE WIDTH | 82 - |
| 33 - | 83 - |
| 34 - FIRST POINT | 84 - |
| 35 - | 85- |
| 36 - SECOND POINT | 86 - |
| 37 - | 87 - |
| 38 - THIRD POINT | 88 - |
| 39 - | 89 - |
| 40 - FIRST END OF 22 | 90 - |
| 41 - | 91 - |
| 42 - SECOND END OF 22 | 92 - |
| 43 - | 93 - |
| 44 - LONGITUDINAL EDGE OF 40 | 94 - |
| 45 - | 95 - |
| 46 - LONGITUDINAL EDGE OF 42 | 96 - |
| 47 - | 97 - |
| 48 - UNDERSIDE OF 20 | 98 - |
| 49 - | 99 - |

-continued

Titre: SPORTS GARMENT FOR COVERING PROTECTIVE EQUIPMENT - #1979854

| No. Dossier 17720-40US | Date: 5 JANVIER 2006 |
|---|---|
| 50 - TRANSVERSAL EDGE | 100 - |
| 101 - | 151 - |
| 102 - | 152 - TRANSVERSAL EDGE |
| 103 - | 153 - |
| 104 - | 154 - |
| 105 - | 155 - |
| 106 - | 156 - |
| 107 - | 157 - |
| 108 - | 158 - |
| 109 - | 159 - |
| 110 - | 160 - |
| 111 - | 161 - |
| 112 - | 162 - |
| 113 - | 163 - |
| 114 - | 164 - |
| 115 - | 165 - |
| 116 - | 166 - |
| 117 - | 167 - |
| 118 - | 168 - |
| 119 - | 169 - |
| 120 - | 170 - |
| 121 - | 171 - |
| 122 - INSERT | 172 - |
| 123 - | 173 - |
| 124 - | 174 - |
| 125 - | 175 - |
| 126 - | 176 - |
| 127 - | 177 - |
| 128 - | 178 - |
| 129 - | 179 - |
| 130 - | 180 - |
| 131 - | 181 - |
| 132 - | 182 - |
| 133 - | 183 - |
| 134 - | 184 - |
| 135 - | 185 - |
| 136 - | 186 - |
| 137 - | 187 - |
| 138 - | 188 - |
| 139 - | 189 - |
| 140 - FIRST END OF 122 | 190 - |
| 141 - | 191 - |
| 142 - SECOND END OF 122 | 192 - |
| 143 - | 193 - |
| 144 - LONGITUDINAL | 194 - |
| EDGE OF 140 (a,b) | 195 - |
| 145 - CUT-OUT IN 122 | 196 - |
| 146 - LONGITUDINAL EDGE OF 142 | 197 - |
| 147 - DOTTED LINE | 198 - |
| 148 - | 199 - |
| 149 - CUT OUT EDGE | 200 - |
| 150 - TRANSVERSAL EDGE | 251 - |
| 201 - | 252 - |
| 202 - | 253 - |
| 203 - | 254 - |
| 204 - | 255 - |
| 205 - | 256 - |
| 206 - | 257 - |
| 207 - | 258 - |
| 208 - | 259 - |
| 209 - | 260 - |
| 210 - PANTS | 261 - |
| 211 - | 262 - |
| 212 - TUBULAR BODY | 263 - |
| 213 - | 264 - |
| 214 - | 265 - |
| 215 - | 266 - |
| 216 - | 267 - |
| 217 - | 268 - |
| 218 - | 269 - |
| 219 - | 270 - |
| 220 - LEG | 271 - |
| 221 - | 272 - |
| 222 - INSERT | 273 - |
| 223 - | 274 - |

-continued

Titre: SPORTS GARMENT FOR COVERING PROTECTIVE EQUIPMENT - #1979854

| No. Dossier 17720-40US | Date: 5 JANVIER 2006 |
|---|---|
| 224 - MINIMUM LENGTH | 275 - |
| 225 - | 276 - |
| 226 - MAXIMUM LENGTH | 277 - |
| 227 - | 278 - |
| 228 - BACK OF 20 | 279 - |
| 229 - | 280 - |
| 230 - FRONT OF 20 | 281 - |
| 231 - | 282 - |
| 232 - | 283 - |
| 233 - | 284 - |
| 234 - FIRST POINT | 285 - |
| 235 - | 286 - |
| 236 - SECOND POINT | 287 - |
| 237 - | 288 - |
| 238 - THIRD POINT | 289 - |
| 239 - | 290 - |
| 240 - | 291 - |
| 241 - | 292 - |
| 242 - | 293 - |
| 243 - | 294 - |
| 244 - | 295 - |
| 245 - | 296 - |
| 246 - | 297 - |
| 247 - | 298 - |
| 248 - | 299 - |
| 249 - | 300 - |
| 250 - | |

DOCSMTL-#1980630-v1-Reference_numerals.XLS

The invention claimed is:

1. A garment comprising:

a substantially tubular body defining interconnected chest, back and shoulder portions configured for respectively covering a chest, a back and shoulders of a wearer; and two sleeves each including at least one tubular portion extending from the body and configured for surrounding at least part of a corresponding arm of the wearer, each tubular portion including a tubular insert having a length increasing around a perimeter thereof from a minimum length to a maximum length, the tubular insert providing excess material in the tubular portion along the maximum length to locally increase a width of the tubular portion, the tubular insert consisting in a monolithic piece of material having transversal edges defining opposed ends of the insert, the insert being asymmetrical with respect to a transversal central line thereof, wherein the transversal central line is transverse to a longitudinal length of the sleeves a distance between the transversal edges varying to define the minimum length and the maximum length.

2. The garment according to claim 1, wherein the transversal edges are curved and curve away from each other at the maximum length.

3. The garment according to claim 1, wherein the transversal edges are curved and curve toward each other at the minimum length.

4. The garment according to claim 1, wherein the tubular insert is configured to be located around a joint of an elbow of the wearer, the maximum length being located substantially over the elbow.

5. The garment according to claim 4, wherein the maximum length is selected such that the tubular insert is configured to overlap and surround an elbow pad to be worn over the elbow.

6. The garment according to claim 1, wherein the transversal edges are asymmetrical relative to one another.

7. A garment comprising:

a substantially tubular body defining interconnected chest, back and shoulder portions configured for respectively covering a chest, a back and shoulders of a wearer; and two sleeves each including at least one tubular portion extending from the body along a respective longitudinal direction and configured for surrounding at least part of an arm of the wearer, each tubular portion including a tubular insert having a width defined transversely to the respective longitudinal direction, the width progressively increasing from a first point on the tubular insert to a second point on the tubular insert and progressively decreasing from the second point to a third point on the tubular insert, the first point being closer to a connection between the tubular portion and the body than the third point and the second point being located between the first and third points, the first, second and third points being aligned along the longitudinal direction of the sleeve.

8. The garment according to claim 7, wherein each sleeve is configured such that the second point is substantially aligned with an elbow of the wearer.

9. The garment according to claim 7 wherein the width between the first and third points is selected such that the tubular body is configured to surround an elbow pad to be worn over the elbow.

10. The garment according to claim 7, wherein the insert is asymmetrical.

11. The garment according to claim 7, wherein the insert is connected to a remainder of the sleeve through opposed transversal edges spaced apart along the longitudinal direction, the transversal edges curving away from each other along a portion of the insert.

12. The garment according to claim 7, wherein the insert is connected to a remainder of the sleeve through opposed transversal edges spaced apart along the longitudinal direction, the transversal edges curving toward each other along a portion of the insert.

* * * * *